US008093974B2

(12) United States Patent
Nagura et al.

(10) Patent No.: US 8,093,974 B2
(45) Date of Patent: Jan. 10, 2012

(54) ELECTROMAGNETIC RELAY

(75) Inventors: Hiroshi Nagura, Okazaki (JP); Takashi Ito, Nagoya (JP); Masaki Takeyama, Okazaki (JP)

(73) Assignee: Anden Co., Ltd., Anjo (JP)

( * ) Notice: Subject to any disclaimer, the term of this patent is extended or adjusted under 35 U.S.C. 154(b) by 142 days.

(21) Appl. No.: 12/461,970

(22) Filed: Aug. 31, 2009

(65) Prior Publication Data

US 2010/0066471 A1 Mar. 18, 2010

(30) Foreign Application Priority Data

Sep. 12, 2008 (JP) ..... 2008-234438
Feb. 2, 2009 (JP) ..... 2009-021296

(51) Int. Cl.
*H01H 9/02* (2006.01)
*H01H 13/04* (2006.01)

(52) U.S. Cl. ..... 335/201; 335/78

(58) Field of Classification Search ..... 335/78–86, 335/128–130, 201, 202
See application file for complete search history.

(56) References Cited

U.S. PATENT DOCUMENTS 4,485,283 A * 11/1984 Hurtle ..... 218/22
5,015,979 A * 5/1991 Nakanishi et al. ..... 335/83
6,222,174 B1 * 4/2001 Tullis et al. ..... 250/208.1
6,242,707 B1 * 6/2001 Mody et al. ..... 218/1
7,843,682 B2 * 11/2010 Leinen et al. ..... 361/652
2010/0193475 A1 * 8/2010 Kamiya et al. ..... 218/157

FOREIGN PATENT DOCUMENTS

JP A-2005-203290 7/2005

OTHER PUBLICATIONS

U.S. Appl. No. 12/461,780, filed Aug. 25, 2009, Nagura et al.

* cited by examiner

*Primary Examiner* — Bernard Rojas
(74) *Attorney, Agent, or Firm* — Posz Law Group, PLC

(57) ABSTRACT

An electromagnetic relay includes a housing having an accommodating space therein, a magnet coil in the accommodating space to generate electromagnetic force when energized, a moving contact disposed in the accommodating space and driven by the coil, a fixed contact in the accommodating space, the moving contact engaged with or disengaged from the fixed contact as a result of whether the moving contact is driven or not, a breathing hole formed in the housing to communicate between the accommodating space and an exterior space of the housing, and a flame propagation route along which a flame of flammable gas ignited by arc generated between the moving contact and the fixed contact propagates toward the breathing hole. The route includes a flame extinguishment clearance that is set to have such a gap size that the flame is extinguished when passing through the clearance.

20 Claims, 6 Drawing Sheets

ELECTROMAGNETIC RELAY

CROSS REFERENCE TO RELATED APPLICATION

This application is based on and incorporates herein by reference Japanese Patent Application No. 2008-234438 filed on Sep. 12, 2008, and Japanese Patent Application No. 2009-021296 filed on Feb. 2, 2009.

BACKGROUND OF THE INVENTION

1. Field of the Invention

The present invention relates to an electromagnetic relay which opens and closes an electric circuit.

2. Description of Related Art

According to a conventional electromagnetic relay described in the publication JP-A-2005-203290, a fixed contact is positioned and held at a predetermined position by a fixed contact holding member, and the moving contact is engaged with or disengaged from the fixed contact by driving a moving member, on which a moving contact is attached, by electromagnetic force of a magnet coil. As a result, the conventional relay opens or closes an electric circuit. Furthermore, an accommodating space in a housing, in which components such as the magnet coil are arranged, communicates with an exterior space of the housing through a breathing hole.

However, when the conventional electromagnetic relay having the breathing hole is used under an environment in which flammable gas is generated, flammable gas flows into the accommodating space through the breathing hole, and the flammable gas which has flowed into the accommodating space is ignited by arc generated between the moving contact and the fixed contact. If the ignited flame propagates to the exterior space of the housing through the breathing hole, flammable gas that exists in the exterior space of the housing may catch fire from the flame.

SUMMARY OF THE INVENTION

The present invention addresses the above disadvantages. Thus, it is an objective of the present invention to provide an electromagnetic relay configured such that a flame of flammable gas ignited by arc does not propagate to an exterior space of a housing.

To achieve the objective of the present invention, there is provided an electromagnetic relay including a housing, a magnet coil, a moving contact; a fixed contact, a breathing hole, and a flame propagation route. The housing has an accommodating space inside the housing. The magnet coil is disposed in the accommodating space and configured to generate electromagnetic force when energized. The moving contact is disposed in the accommodating space and driven by the magnet coil as a result of energization of the magnet coil. The fixed contact is disposed in the accommodating space. The moving contact is engaged with or disengaged from the fixed contact as a result of whether the moving contact is driven or not. The breathing hole is formed in the housing so as to communicate between the accommodating space and an exterior space of the housing. A flame of flammable gas ignited by arc generated between the moving contact and the fixed contact propagates toward the breathing hole along the flame propagation route. The flame propagation route includes a flame extinguishment clearance that is set to have such a gap size that the flame is extinguished when passing through the flame extinguishment clearance.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
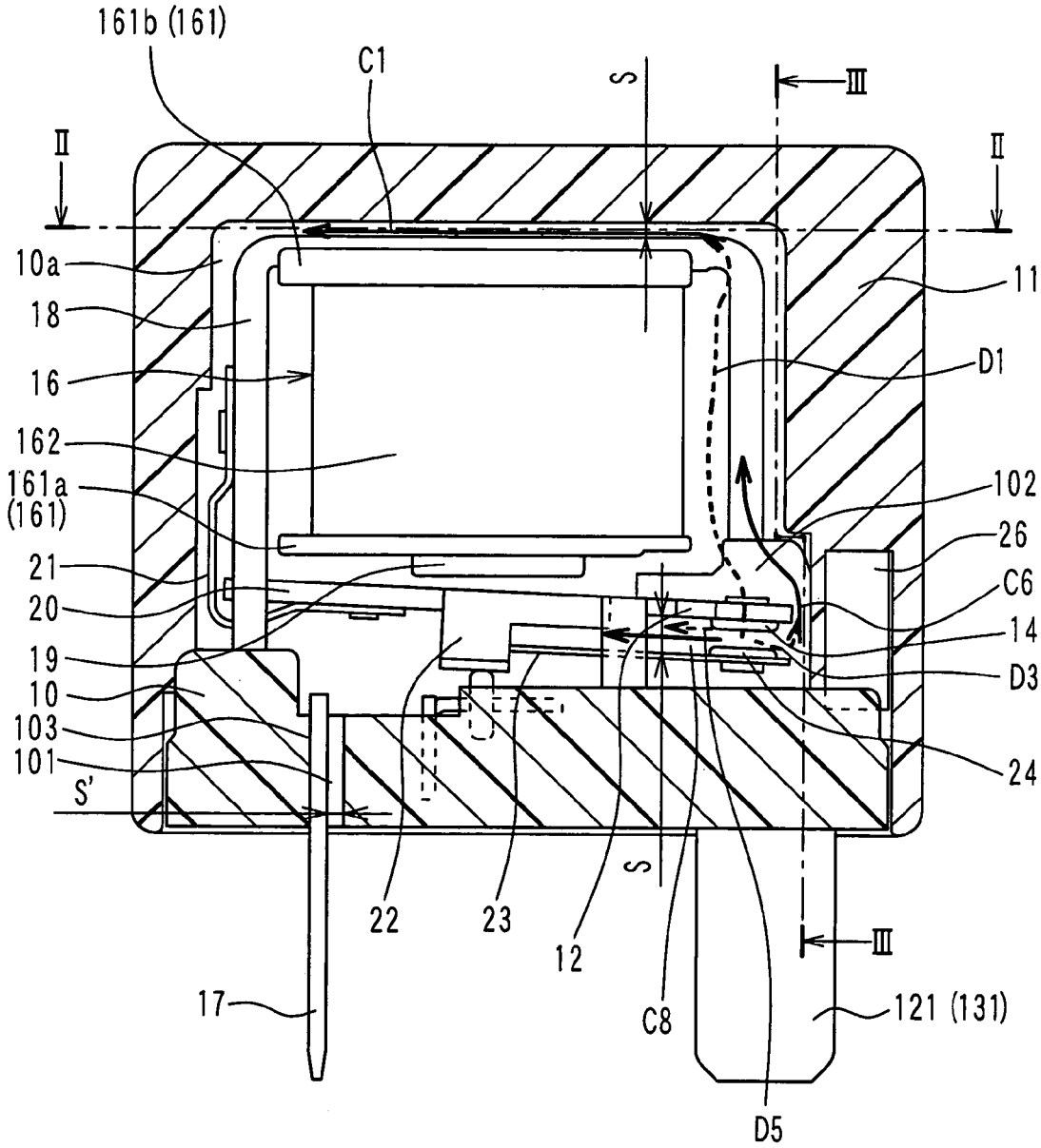
FIG. 1 is a sectional view illustrating an electromagnetic relay in accordance with a first embodiment of the invention.

Embodiments of the invention are described below with reference to the accompanying drawings. The same numerals are used in the drawings to indicate the same or equivalent parts in the following embodiments.

First Embodiment

A first embodiment of the invention is described below with reference to FIG. 1 to FIG. 3.

An electromagnetic relay according to the present embodiment is used for an electric motorcar with an electric motor as a driving source of its travel. More specifically, a lithium ion battery is installed in the electric motorcar for supplying electric power to the electric motor, and the electromagnetic relay is disposed in an electric circuit, through which electric power for charging is supplied to a capacitor from the lithium ion battery.

Battery fluid of the lithium ion battery includes organic solvent (such as dimethyl carbonate (DMC) or ethyl methyl carbonate (EMC)). If temperature of the battery fluid rises due to overcharge, for example, the dimethyl carbonate or ethyl methyl carbonate gasifies. In addition, gasified dimethyl carbonate or gasified ethyl methyl carbonate is flammable gas.

The electromagnetic relay of the present embodiment may be used for an electric motorcar in which a fuel cell is installed. Hydrogen gas, which is flammable gas, is used in the fuel cell.

Figure 2:
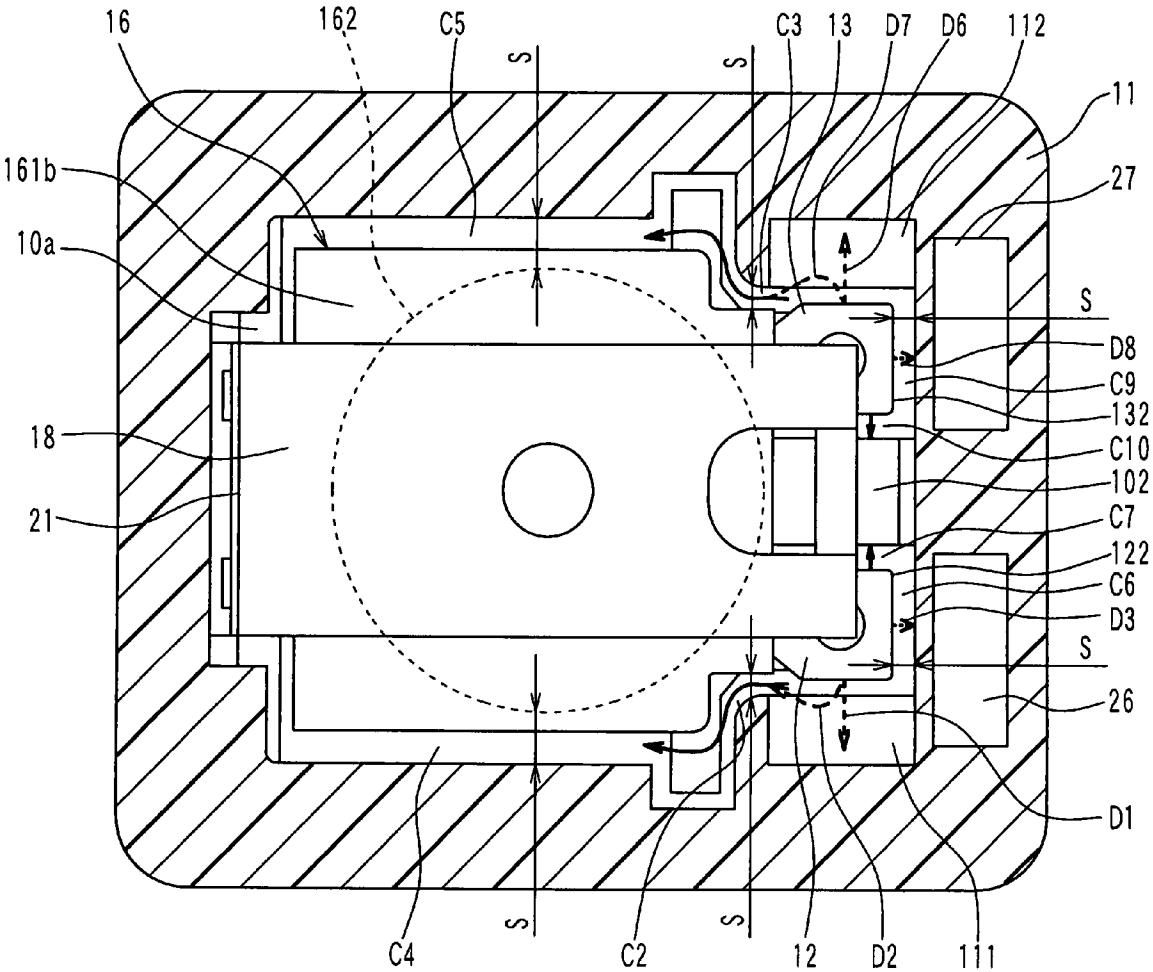
FIG. 2 is a cross-sectional view taken along a line II-II in FIG. 1.
Figure 3:
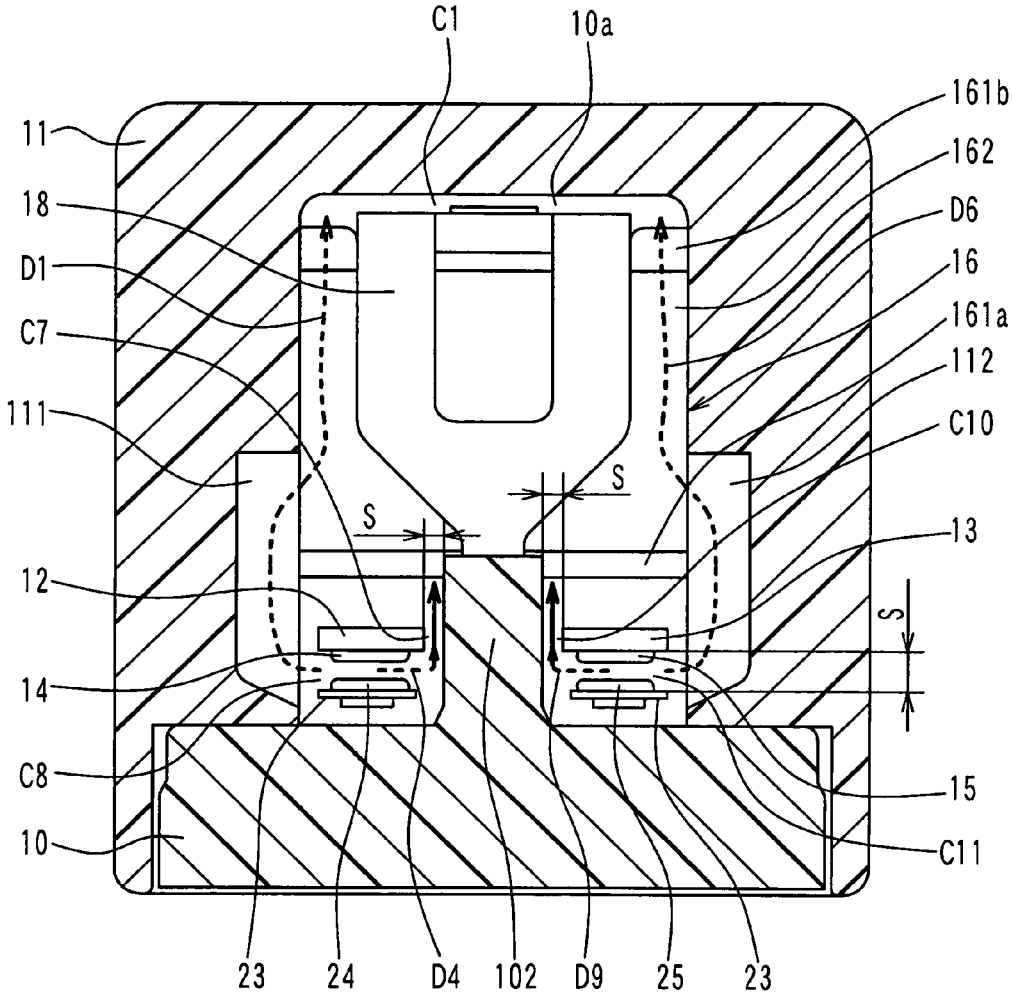
FIG. 3 is a sectional view taken along a line III-III in FIG. 1.
Figure 4:
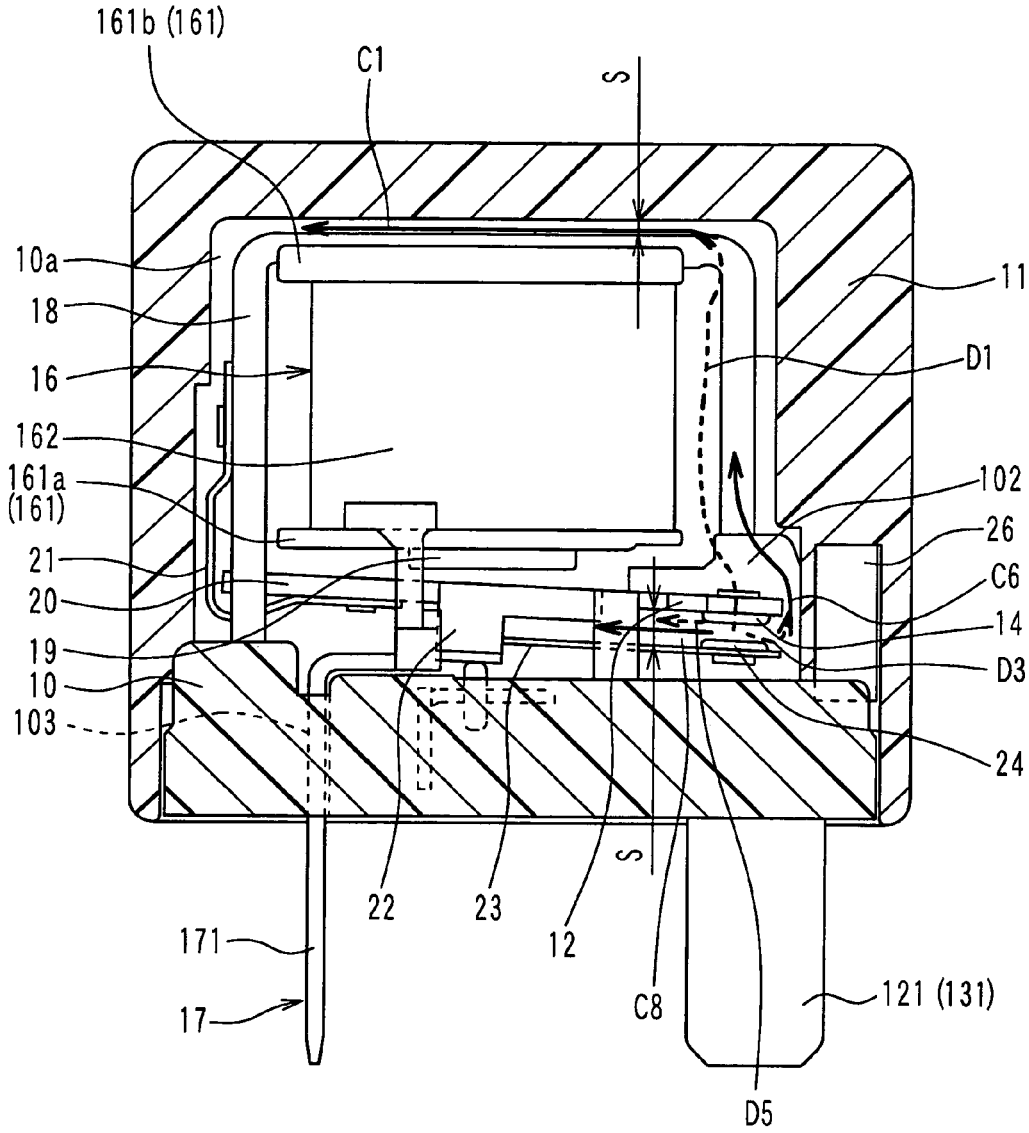
FIG. 4 is a sectional view illustrating an electromagnetic relay in accordance with a second embodiment of the invention.
Figure 5:
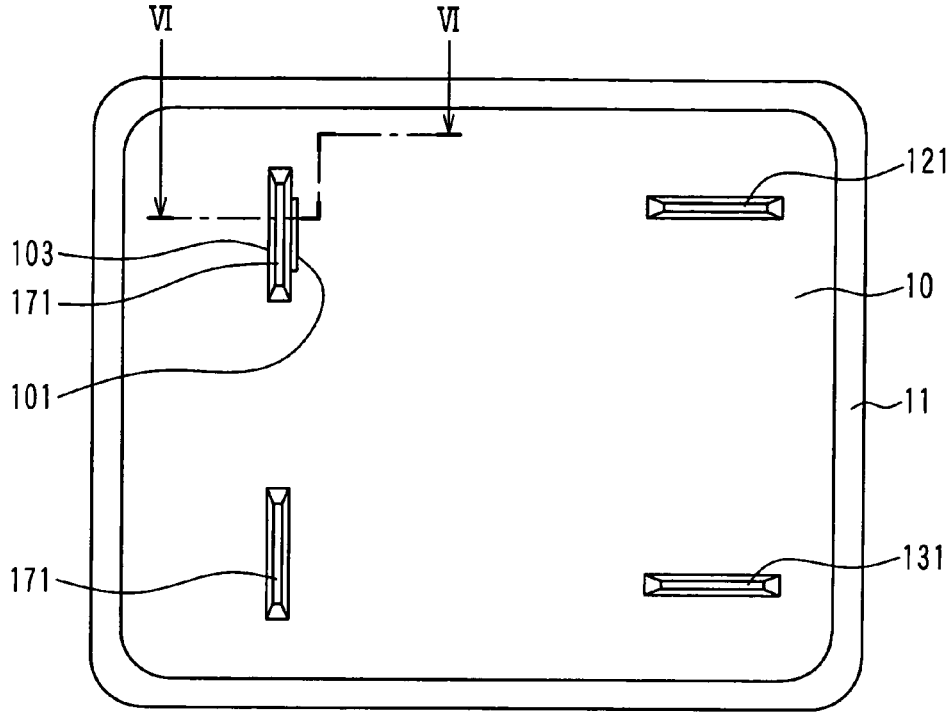
FIG. 5 is a bottom view of FIG. 4.
Figure 6:
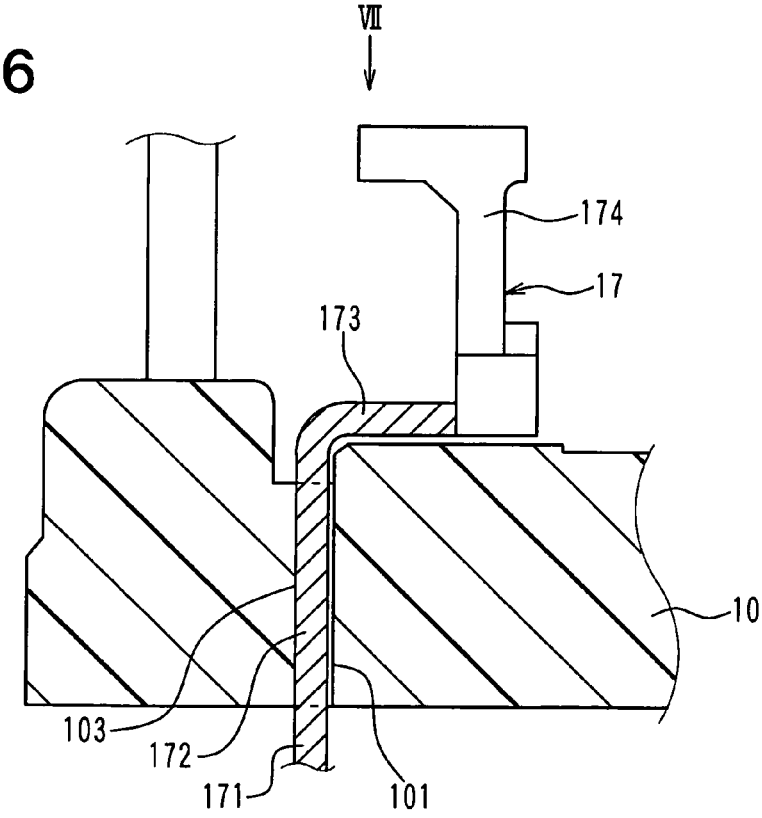
FIG. 6 is a sectional view taken along a line VI-VI in FIG. 5.
Figure 7:
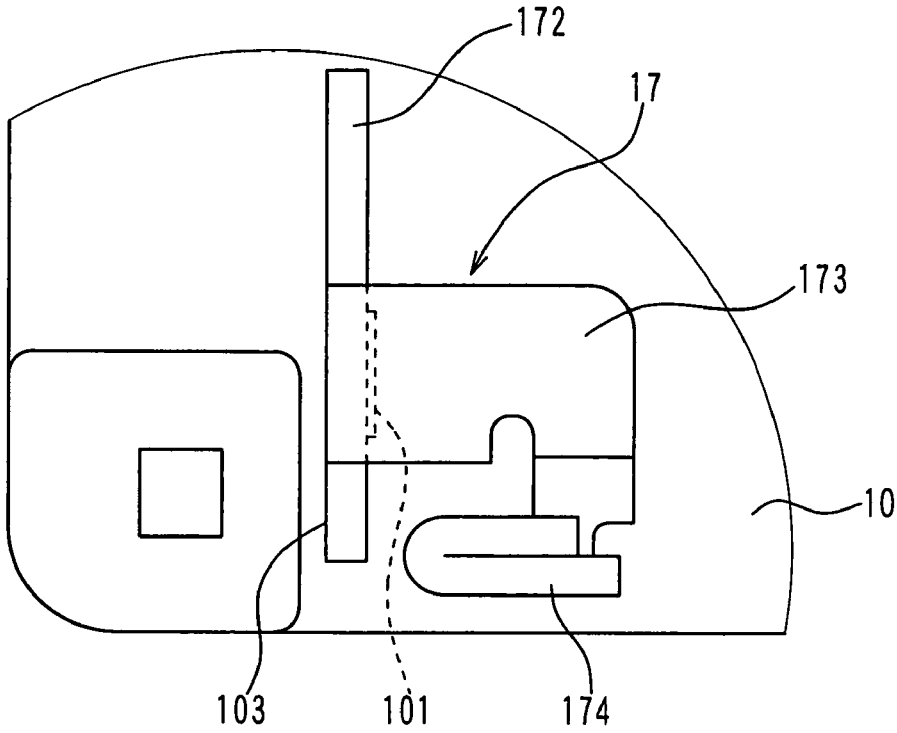
FIG. 7 is a diagram viewed from a direction of an arrow F in FIG. 6.

As shown in FIG. 1 to FIG. 3, according to the electromagnetic relay of the present embodiment, a case 11 formed in a rectangular parallelepiped is fitted to a plate-like base 10 made of resin, and the case 11 is made of resin and has a cylindrical shape having a bottom portion. An accommodating space 10*a* is defined inside the relay by the base 10 and the case 11. The accommodating space 10*a* communicates with an exterior space of the base 10 and the case 11 through a breathing hole 101 formed in the base 10. The base 10 and the case 11 may constitute a "housing" of the invention.

Two fixed contact holding members 12, 13 made of conductive metal are fixed to the base 10. The two fixed contact holding members 12, 13 penetrate through the base 10, and their one end side is located in the accommodating space 10*a*, whereas the other end side is located in an exterior space.

Fixed contacts 14, 15 made of conductive metal are calked and fixed respectively on end portions of the two fixed contact holding members 12, 13 on the accommodating space 10*a* side. The two fixed contacts 14, 15 are positioned and held at predetermined positions by the two fixed contact holding members 12, 13.

Load circuit terminals 121, 131 connected to an external harness (not shown) are formed respectively on the exterior space sides of the two fixed contact holding members 12, 13. The load circuit terminal 121 of the first fixed contact holding member 12 is connected to the lithium ion battery (not shown) via the external harness, and the load circuit terminal 131 of the second fixed contact holding member 13 is connected to the capacitor (not shown) via the external harness.

Two coil terminals 17 (only one of them is shown) connected to a magnet coil 16 and made of conductive metal, are fixed respectively to the base 10 by press fitting, for example. More specifically, a coil terminal insertion hole 103 which communicates between the accommodating space 10*a* and the exterior space and in which the coil terminal 17 is inserted is formed in the base 10. The coil terminal insertion hole 103 and the breathing hole 101 are formed adjacently in a communicating state. The coil terminal 17 is inserted in the coil terminal insertion hole 103. One end side of the coil terminal 17 is located in the accommodating space 10*a*, and the other end side of the coil terminal 17 is located in the exterior space.

The magnet coil 16 includes a bobbin 161 made of resin and a coil wire 162 which is wound around a cylindrical portion (not shown) of the bobbin 161 and an end portion of which is connected to the coil terminal 17. The magnet coil 16 generates electromagnetic force when energized. The bobbin 161 includes a first flanged portion 161*a* located on an armature 20 side and a second flanged portion 161*b* located on an opposite side of the magnet coil 16 from the armature 20. The armature 20 is described in greater detail hereinafter. A fixed core 19 made of a magnetic metallic material is disposed in the cylindrical portion of the bobbin 161.

The yoke 18 is made of a magnetic metallic material, and bent in a U-shaped manner. The yoke 18 constitutes a magnetic path of magnetic flux induced by the magnet coil 16. The yoke 18 is fixed to the base 10 by press-fitting, for example, and the magnet coil 16 is fixed to the yoke 18.

An armature 20 made of magnetic metal is disposed in a position opposed to the fixed core 19, and the armature 20 is attracted to the fixed core 19 side upon energization of the magnet coil 16. The armature 20 is connected to the yoke 18 via a connecting plate 21 made of metal and bent in a generally L-shape. The connecting plate 21 applies elastic force, which is in a direction in which the armature 20 disengages from the fixed core 19, to the armature 20 when the magnet coil 16 is not energized.

A U-shaped flat spring 23 made of conductive metal is connected to the armature 20 via a connecting member 22 made of resin. Moving contacts 24, 25 made of conductive metal are calked and fixed on both ends of the flat spring 23, and the first moving contact 24 is opposed to the first fixed contact 14, whereas the second moving contact 25 is opposed to the second fixed contact 15.

A first permanent magnet 26 for applying Lorentz force to arc that is generated when the first moving contact 24 disengages from the first fixed contact 14 is disposed on a lateral side of the first fixed contact 14 and the first moving contact 24. A second permanent magnet 27 for applying Lorentz force to arc that is generated when the second moving contact 25 disengages from the second fixed contact 15 is disposed on a lateral side of the second fixed contact 15 and the second moving contact 25. These permanent magnets 26, 27, which are formed in a cylindrical shape, are inserted respectively in recesses formed on the side wall of the case 11.

The first fixed contact holding member 12 and the flat spring 23 extend parallel to each other and in a direction away from the first permanent magnet 26. The second fixed contact holding member 13 and the flat spring 23 extend parallel to each other and in a direction away from the second permanent magnet 27.

A partition wall 102 projecting into the accommodating space 10*a* is formed on the base 10. With this partition wall 102, a space in which the first fixed contact 14 and the first moving contact 24 are disposed is divided off from a space in which the second fixed contact 15 and the second moving contact 25 are disposed.

A recessed or grooved first guide part 111 is formed on an inner wall part of the case 11 on an opposite side of the first fixed contact 14 and the first moving contact 24 from the partition wall 102. The first guide part 111 extends in a direction parallel to an alignment direction of the first fixed contact 14 and the first moving contact 24 and thereby guides arc, which has collided with the first guide part 111, in a direction generally parallel to the alignment direction.

A recessed or grooved second guide part 112 is formed on an inner wall part of the case 11 on an opposite side of the second fixed contact 15 and the second moving contact 25 from the partition wall 102. The second guide part 112 extends in a direction parallel to an alignment direction of the second fixed contact 15 and the second moving contact 25 and thereby guides arc, which has collided with the second guide part 112, in a direction generally parallel to the alignment direction.

As described above, the electromagnetic relay of the present embodiment is used under an environment in which flammable gas may be generated. If flammable gas is generated, the flammable gas flows into the accommodating space 10*a* through the breathing hole 101, and the flammable gas which has flowed into the accommodating space 10*a* is ignited by the arc generated between the fixed contacts 14, 15 and the moving contacts 24, 25 respectively.

Accordingly, in the present embodiment, by forming flame extinguishment clearances C1 to C11 that is set to have such a gap size S that they can extinguish the flame in a flame propagation route along which a flame of flammable gas ignited by the arc propagates toward the breathing hole 101, the propagation of flame to the exterior space is prevented. Furthermore, by setting a gap size S' of the breathing hole 101 at such a size that it can extinguish the flame, the propagation of flame to the exterior space is prevented more reliably.

The flame extinguishment clearances C1 to C11 are formed at eleven places respectively as described below. Specifically, a first flame extinguishment clearance C1 (see FIG. 1 and FIG. 3) is formed between a region of the yoke 18 on its opposite side from the base 10 (i.e., on the second flanged portion 161*b* side of the bobbin 161) and the case 11; a second flame extinguishment clearance C2 and a third flame extinguishment clearance C3 are formed (see FIG. 2) between side surfaces of the second flanged portion 161*b* and the case 11; and a fourth flame extinguishment clearance C4 and a fifth flame extinguishment clearance C5 are formed (see FIG. 2) between an outer circumferential surface of the coil wire 162 and the case 11.

A sixth flame extinguishment clearance C6 (see FIG. 1 and FIG. 2) is formed between an end face 122 of the first fixed contact holding member 12 on its one end side, on which the first fixed contact 14 is attached, and the case 11; a seventh flame extinguishment clearance C7 (see FIG. 2 and FIG. 3) is formed between the partition wall 102 and the first fixed contact holding member 12; and a eighth flame extinguishment clearance C8 (see FIG. 1 and FIG. 3) is formed between the first fixed contact holding member 12 and the flat spring 23.

A ninth flame extinguishment clearance C9 (see FIG. 2) is formed between an end face 132 of one end side of the second fixed contact holding member 13, on which the second fixed contact 15 is attached, and the case 11; a tenth flame extinguishment clearance C10 (see FIG. 2 and FIG. 3) is form ed between the partition wall 102 and the second fixed contact holding member 13; and an eleventh flame extinguishment clearance C11 (see FIG. 3) is formed between the second fixed contact holding member 13 and the flat spring 23.

Additionally, when the flammable gas is gasified dimethyl carbonate or gasified ethyl methyl carbonate, the flame is reliably extinguished by setting the gap sizes S, S' at 2 mm or less. When the flammable gas is hydrogen gas, the flame is reliably extinguished by setting the gap sizes S, S' at 0.6 mm or less.

Next, workings of the electromagnetic relay according to the present embodiment are explained. First, when the magnet coil 16 is energized, the armature 20 is attracted toward the fixed core 19 by electromagnetic force generated as a result of the energization. Then, the first moving contact 24 is brought into contact with the first fixed contact 14 and the second moving contact 25 is brought into contact with the second fixed contact 15. Accordingly, the two fixed contacts 14, 15 are connected by the flat spring 23 so as to close an electric circuit. On the other hand, when the energization of the magnet coil 16 is stopped, the moving contacts 24, 25 are disengaged respectively from the fixed contacts 14, 15 by the elastic force of the connecting plate 21 so as to open the electric circuit.

An arrow of a short dashed line in FIG. 1 to FIG. 3 indicates a flame propagation route along which the flame ignited by the arc propagates toward the breathing hole 101. An arrow of a continuous line in FIG. 1 to FIG. 3 indicates a generally illustrated region in which the flame is extinguished.

When the flammable gas which has flowed into the accommodating space 10*a* catches fire from the arc generated between the fixed contacts 14, 15 and the moving contacts 24, 25 respectively, the flame caused by this ignition is extinguished as follows.

Workings for extinguishing the flame of the flammable gas which catches fire from the arc generated between the first fixed contact 14 and the first moving contact 24 are described below.

Heat is conducted away from a flame propagating along a first flame propagation route D1 (see FIG. 1 to FIG. 3), which leads to the opposite side from the base 10 through the first guide part 111, by the members (i.e., the yoke 18 and the case 11) that constitute the first flame extinguishment clearance C1 while the flame is passing through the clearance C1. Accordingly, the flame is not maintained to be extinguished.

Heat is drawn from a flame propagating along a second flame propagation route D2 (see FIG. 2), which leads to a side surface of the second flanged portion 161*b* or an outer circumferential surface of the coil wire 162, by the members (i.e., the second flanged portion 161*b* and the case 11) that constitute the second flame extinguishment clearance C2 or by the members (i.e., the coil wire 162 and the case 11) that constitute the fourth flame extinguishment clearance C4, while the flame is, passing through the second flame extinguishment clearance C2 or the fourth flame extinguishment clearance C4. As a result, the flame is extinguished.

The members (i.e., the first fixed contact holding member 12 and the case 11) that constitute the sixth flame extinguishment clearance C6 provide heat removal from a flame, propagating along a third flame propagation route D3 (see FIG. 1 and FIG. 2), which passes between the end face 122 of the first fixed contact holding member 12 and the case 11, while the flame is passing through the sixth flame extinguishment clearance C6. Accordingly, the flame is extinguished.

The members (i.e., the first fixed contact holding member 12 and the partition wall 102) that constitute the seventh flame extinguishment clearance C7 conduct heat away from a flame propagating along a fourth flame propagation route D4 (see FIG. 3), which passes between the partition wall 102 and the first fixed contact holding member 12, while the flame is passing through the seventh flame extinguishment clearance C7. As a result, the flame.

The members (i.e., the first fixed contact holding member 12 and the flat spring 23) that constitute the eighth flame extinguishment clearance C8 draw heat from a flame propagating along a fifth flame propagation route D5 (see FIG. 1), which passes between the first fixed contact holding member 12 and the flat spring 23, while the flame is passing through the eighth flame extinguishment clearance C8. Accordingly, the flame is extinguished.

In the above-described manner, the flame of the flammable gas which catches fire from the arc generated between the first fixed contact 14 and the first moving contact 24 is extinguished.

Next, workings for extinguishing the flame of the flammable gas which catches fire from the arc generated between the second fixed contact 15 and the second moving contact 25 are described below.

Heat is conducted away from a flame propagating along a sixth flame propagation route D6 (see FIG. 2 to FIG. 3), which leads to the opposite side from the base 10 through the second guide part 112, by the members (i.e., the yoke 18 and the case 11) that constitute the first flame extinguishment clearance C1 while the flame is passing through the clearance C1. Accordingly, the flame is not maintained to be extinguished.

Heat is drawn from a flame propagating along a seventh flame propagation route D7 (see FIG. 2), which leads to a side surface of the second flanged portion 161*b* or an outer circumferential surface of the coil wire 162, by the members (i.e., the second flanged portion 161*b* and the case 11) that constitute the third flame extinguishment clearance C3 or by the members (i.e., the coil wire 162 and the case 11) that constitute the fifth flame extinguishment clearance C5, while the flame is passing through the third flame extinguishment clearance C3 or the fifth flame extinguishment clearance C5. As a result, the flame is extinguished.

The members (i.e., the second fixed contact holding member 13 and the case 11) that constitute the ninth flame extinguishment clearance C9 provide heat removal from a flame propagating along an eighth flame propagation route D8 (see FIG. 2), which passes between the end face 132 of the second fixed contact holding member 13 and the case 11, while the flame is passing through the ninth flame extinguishment clearance C9. Accordingly, the flame is extinguished.

The members (i.e., the second fixed contact holding member 13 and the partition wall 102) that constitute the tenth flame extinguishment clearance C10 conduct heat away from a flame propagating along a ninth flame propagation route D9 (see FIG. 3), which passes between the partition wall 102 and the second fixed contact holding member 13, while the flame is passing through the tenth flame extinguishment clearance C10. As a result, the flame is extinguished.

Heat is drawn by the members (i.e., the second fixed contact holding member 13 and the flat spring 23), which constitute the eleventh flame extinguishment clearance C11, from a flame propagating along a tenth flame propagation route (not shown), which passes between the second fixed contact holding member 13 and the flat spring 23, while the flame is passing through the eleventh flame extinguishment clearance C11. Accordingly, the flame is extinguished.

In the above-described manner, the flame of the flammable gas which catches fire from the arc generated between the second fixed contact 15 and the second moving contact 25 is extinguished.

In addition, in case the flame is not extinguished in any of the first flame extinguishment clearance C1 to the eleventh flame extinguishment clearance C11, the base 10 or the coil terminal 17 draws heat from the flame while the flame is passing through the breathing hole 101, so that the flame is extinguished. Since the coil terminal 17 is made of metal, a large amount of heat of the flame is conducted away by the coil terminal 17, and thereby the flame is reliably extinguished.

As described above, in the present embodiment, the flame of flammable gas ignited by the arc is extinguished in the flame extinguishment clearances C1 to C11, and consequently the propagation of flame to the exterior space is prevented. Consequently, the ignition of flammable gas that exists in the exterior space of the base 10 and the case 11 is prevented.

In case the flame is not extinguished in the flame extinguishment clearances C1 to C11, the flame is extinguished through the breathing hole 101. In other words, because the electromagnetic relay has a dual explosion-proof structure (flame extinguishment structure) that carries out the extinguishment of flame by the flame extinguishment clearances C1 to C11 and the breathing hole 101, the flame of flammable gas ignited by the arc is extinguished even more reliably.

The breathing hole 101 may be set to have such a gap size S' that extinguishes a flame.

Accordingly, since the flame of flammable gas ignited by the arc propagates toward the breathing hole 101 after passing through the flame extinguishment clearances C1 to C11, the flame is extinguished at the flame extinguishment clearances C1 to C11 first, and in case the flame is not extinguished at the clearances C1 to C11, the unextinguished flame is put out while passing through the breathing hole 101. Therefore, the electromagnetic relay has a dual explosion-proof structure (flame extinguishment structure) that carries out the extinguishment of flame with the flame extinguishment clearances C1 to C11 and the breathing hole 101. As a result, the flame of flammable gas ignited by the arc is extinguished even more reliably.

Moreover, gas, which is ignited by the arc so as to burn, is only the gas in a space of the accommodating space 10*a* on an upstream side of the flame extinguishment clearances C1 to C11 along the flame propagation route. Thus, heat is more easily drawn from the combustion gas by the base 10 or the case 11 than when the entire gas in the accommodating space 10*a* combusts. Accordingly, pressure increase in the accommodating space 10*a* becomes small, so that it becomes difficult to cause damage to the base 10 or the case 11.

By appropriately setting the gap size S of the flame extinguishment clearances C1 to C11 in accordance with types of flammable gas (e.g., organic solvent, gasified dimethyl carbonate, gasified ethyl methyl carbonate, and hydrogen gas), a flame of flammable gas ignited by the arc may be securely extinguished.

Second Embodiment

A second embodiment of the invention is explained below with reference to FIG. 4 to FIG. 7. The present embodiment is different from the first embodiment in the constitution of a coil terminal 17. Since the second embodiment is similar to the first embodiment in the other constitutions, only a different part from the first embodiment is explained below.

As shown in FIG. 4 to FIG. 7, the coil terminal 17 is formed in a predetermined shape after a plate material made of conductive metal is stamped and then bent at two or more positions. The coil terminal 17 includes a connecting terminal plate portion 171 projecting into an exterior space and connected to an external harness (not shown), and an insertion plate portion 172 joined to the connecting terminal plate portion 171 and located in a coil terminal insertion hole 103.

The coil terminal 17 is bent over on the opposite side of the insertion plate portion 172 from the connecting terminal plate portion 171, in other words, it is bent over at a boundary part between the coil terminal insertion hole 103 and an accommodating space 10*a*, so as to be formed into a covering plate portion 173. The covering plate portion 173 covers an opening of a breathing hole 101 on the accommodating space 10*a* side, and extends generally parallel to a surface of a base 10 on the accommodating space 10*a* side.

The coil terminal 17 is bent over on the opposite side of the covering plate portion 173 from the insertion plate portion 172 so as to be formed into a wire connecting plate portion 174. A coil wire 162 is connected to an end portion of this wire connecting plate portion 174.

Additionally, when foreign substances such as resin which have entered into the accommodating space 10*a* in the manufacturing process are heated by the arc, and the foreign substance pass through the breathing hole 101 with a gas stream, flammable gas that exists in the exterior space may take fire due to a spark in the foreign substance.

In the present embodiment, because the opening of a breathing hole 101 on the accommodating space 10*a* side is covered with the covering plate portion 173, it is difficult for the foreign substances to pass through the breathing hole 101. Therefore, the ignition of the flammable gas that exists in the exterior space by the spark in the foreign substance is prevented.

Furthermore, when the flame passes between the covering plate portion 173 and the surface of the base 10 opposed to the covering plate portion 173 as well, the covering plate portion 173 and the base 10 conduct heat away from the flame. Accordingly, the flame is extinguished even more reliably.

Additional advantages and modifications will readily occur to those skilled in the art. The invention in its broader terms is therefore not limited to the specific details, representative apparatus, and illustrative examples shown and described.

What is claimed is:

1. An electromagnetic relay comprising:

a housing having an accommodating space inside the housing;

a magnet coil disposed in the accommodating space and configured to generate electromagnetic force when energized;

a moving contact disposed in the accommodating space and driven by the magnet coil as a result of energization of the magnet coil;

a fixed contact disposed in the accommodating space, wherein the moving contact is engaged with or disengaged from the fixed contact as a result of whether the moving contact is driven or not;

a breathing hole formed in the housing so as to communicate between the accommodating space and an exterior space of the housing;

a flame propagation route along which a flame of flammable gas ignited by arc generated between the moving contact and the fixed contact propagates toward the breathing hole;

a coil terminal made of metal, one end of which is connected to the magnet coil, and the other end of which projects into an outside of the housing; and a coil terminal insertion hole formed in the housing so as to communicate between the accommodating space and the exterior space of the housing, the coil terminal inserted into the coil terminal insertion hole, wherein the breathing hole is formed adjacent to the coil terminal insertion hole with the breathing hole communicating with the coil terminal insertion hole, the flame propagation route includes a plurality of flame extinguishment clearances, each of which is set to have such a gap size that the flame is extinguished when passing through each of the plurality of flame extinguishment clearances, and a gap size of the breathing hole is set at such a size as to extinguish the flame.

2. The electromagnetic relay according to claim 1, wherein:

the electromagnetic relay is used under an environment in which gasified organic solvent flows into the accommodating space; and the gap size of the flame extinguishment clearance is equal to or smaller than 2 mm.

3. The electromagnetic relay according to claim 2, wherein the breathing hole is set to have such a gap size that the flame is extinguished when passing through the breathing hole.

4. The electromagnetic relay according to claim 3, wherein the coil terminal includes a covering plate portion that is bent over at a boundary part between the coil terminal insertion hole and the accommodating space so as to cover an opening of the breathing hole on a side of the accommodating space.

5. The electromagnetic relay according to claim 1, wherein:

the electromagnetic relay is used under an environment in which gasified dimethyl carbonate flows into the accommodating space; and the gap size of the flame extinguishment clearance is equal to or smaller than 2 mm.

6. The electromagnetic relay according to claim 5, wherein the breathing hole is set to have such a gap size that the flame is extinguished when passing through the breathing hole.

7. The electromagnetic relay according to claim 6, wherein the coil terminal includes a covering plate portion that is bent over at a boundary part between the coil terminal insertion hole and the accommodating space so as to cover an opening of the breathing hole on a side of the accommodating space.

8. The electromagnetic relay according to claim 1, wherein:

the electromagnetic relay is used under an environment in which gasified ethyl methyl carbonate flows into the accommodating space; and the gap size of the flame extinguishment clearance is equal to or smaller than 2 mm.

9. The electromagnetic relay according to claim 8, wherein the breathing hole is set to have such a gap size that the flame is extinguished when passing through the breathing hole.

10. The electromagnetic relay according to claim 9, wherein the coil terminal includes a covering plate portion that is bent over at a boundary part between the coil terminal insertion hole and the accommodating space so as to cover an opening of the breathing hole on a side of the accommodating space.

11. The electromagnetic relay according to claim 1, wherein:

the electromagnetic relay is used under an environment in which hydrogen gas flows into the accommodating space; and the gap size of the flame extinguishment clearance is equal to or smaller than 0.6 mm.

12. The electromagnetic relay according to claim 11, wherein the breathing hole is set to have such a gap size that the flame is extinguished when passing through the breathing hole.

13. The electromagnetic relay according to claim 12, wherein the coil terminal includes a covering plate portion that is bent over at a boundary part between the coil terminal insertion hole and the accommodating space so as to cover an opening of the breathing hole on a side of the accommodating space.

14. The electromagnetic relay according to claim 1, wherein the breathing hole is set to have such a gap size that the flame is extinguished when passing through the breathing hole.

15. The electromagnetic relay according to claim 14, wherein the coil terminal includes a covering plate portion that is bent over at a boundary part between the coil terminal insertion hole and the accommodating space so as to cover an opening of the breathing hole on a side of the accommodating space.

16. An electromagnetic relay comprising:

a housing having an accommodating space inside the housing;

a magnet coil disposed in the accommodating space and configured to generate electromagnetic force when energized;

a moving contact disposed in the accommodating space and driven by the magnet coil as a result of energization of the magnet coil;

a fixed contact disposed in the accommodating space, wherein the moving contact is engaged with or disengaged from the fixed contact as a result of whether the moving contact is driven or not;

a breathing hole formed in the housing so as to communicate between the accommodating space and an exterior space of the housing; and a flame propagation route along which a flame of flammable gas ignited by arc generated between the moving contact and the fixed contact propagates toward the breathing hole, wherein the flame propagation route includes a plurality of flame extinguishment clearances, each of the plurality of flame extinguishment clearances is formed to have a corresponding gap size, and each of the corresponding gap sizes is selected such that the flame passing through the plurality of flame extinguishment clearances will be extinguished.

17. The electromagnetic relay according to claim 16, wherein the electromagnetic relay is used under an environment in which gasified organic solvent flows into the accommodating space, and the gap size of the flame extinguishment clearance is equal to or smaller than 2 mm.

18. The electromagnetic relay according to claim 16, wherein the electromagnetic relay is used under an environment in which gasified dimethyl carbonate flows into the accommodating space, and the gap size of the flame extinguishment clearance is equal to or smaller than 2 mm.

19. The electromagnetic relay according to claim 16, wherein the electromagnetic relay is used under an environment in which gasified ethyl methyl carbonate flows into the accommodating space, and the gap size of the flame extinguishment clearance is equal to or smaller than 2 mm.

20. The electromagnetic relay according to claim 16, wherein the electromagnetic relay is used under an environment in which hydrogen gas flows into the accommodating space, and the gap size of the flame extinguishment clearance is equal to or smaller than 0.6 mm.

* * * * *